US005928038A

United States Patent [19]

Berg et al.

[11] Patent Number: 5,928,038

[45] Date of Patent: Jul. 27, 1999

[54] ELECTRICAL CONNECTOR POSITION ASSURANCE SYSTEM

[75] Inventors: Paul Christopher Berg, Batavia; Paul D. Cecil, Jr., Aurora; Clarence Robert Moon, III, Joliet, all of Ill.

[73] Assignee: Molex Incorporated, Lisle, Ill.

[21] Appl. No.: 09/064,356

[22] Filed: Apr. 24, 1998

[51] Int. Cl.[6] ..... H01R 13/434

[52] U.S. Cl. ..... 439/752; 439/489

[58] Field of Search ..... 439/752, 595, 439/352, 357, 358, 489

[56] References Cited

U.S. PATENT DOCUMENTS

| | | | |
|---|---|---|---|
| 5,026,298 | 6/1991 | Brussalis et al. | 439/358 |
| 5,120,240 | 6/1992 | Reider | 439/352 |
| 5,120,255 | 6/1992 | Kouda et al. | 439/489 |
| 5,135,408 | 8/1992 | Suzuki | 439/310 |
| 5,145,356 | 9/1992 | Minnis | 439/352 |
| 5,203,718 | 4/1993 | Chishima | 439/489 |
| 5,203,719 | 4/1993 | Kozono | 439/489 |
| 5,226,834 | 7/1993 | Kato et al. | 439/489 |
| 5,234,356 | 8/1993 | Maejima et al. | 439/352 |
| 5,330,369 | 7/1994 | Nozaki et al. | 439/489 |
| 5,348,493 | 9/1994 | Power | 439/352 |
| 5,429,527 | 7/1995 | Nozaki et al. | 439/489 |
| 5,507,666 | 4/1996 | Yamanashi | 439/489 |
| 5,605,471 | 2/1997 | Plyler | 439/489 |
| 5,605,472 | 2/1997 | Sakai et al. | 439/489 |
| 5,618,201 | 4/1997 | Yagi et al. | 439/489 |
| 5,628,648 | 5/1997 | Higgins, Jr. et al. | 439/489 |
| 5,628,649 | 5/1997 | Yagi et al. | 439/489 |
| 5,643,003 | 7/1997 | Myer et al. | 439/352 |
| 5,655,928 | 8/1997 | Akeda | 439/489 |
| 5,672,073 | 9/1997 | Matsumura et al. | 439/489 |
| 5,681,178 | 10/1997 | Kunkle et al. | 439/352 |
| 5,755,600 | 5/1998 | Yoshida | 439/752 |
| 5,772,477 | 6/1998 | Cloarec et al. | 439/752 |

*Primary Examiner*—Gary Paumen
*Attorney, Agent, or Firm*—Stacey E. Caldwell

[57] ABSTRACT

A connector position assurance system is provided for an electrical connector adapted for mating with another mateable connecting device. A connector housing has at least one terminal-receiving passage and including a locking arm adapted for latching with the mateable connecting device. A terminal is positionable in the passage. A terminal position assurance device (TPA) is mountable on the housing. A connector position assurance device (CPA) is, movably mounted on the housing and is operatively associated with the locking arm. The TPA includes a guide structure for guiding movement of the CPA.

20 Claims, 7 Drawing Sheets

ELECTRICAL CONNECTOR POSITION ASSURANCE SYSTEM

FIELD OF THE INVENTION

This invention generally relates to the art of electrical connectors and, particularly, to a connector position assurance system for an electrical connector adapted to mate with another mateable connecting device.

BACKGROUND OF THE INVENTION

Electrical connectors normally require secure mechanical and electrical engagement between one electrical connector and a mateable electrical connector or other mateable connecting device. Various latching systems have been used with electrical connectors to provide such secure engagement. Such systems usually provide this secure engagement with ease of attachment and detachment. For instance, latching mechanisms have been developed which include pivotally supported latching arms that interlock with each other or that interlock with a complementary latching mechanism of the mateable connector or connecting device.

In addition, connector position assurance devices also are known in the art. Typically, the primary function of such devices is to verify that the connectors are fully mated and latched, i.e. that the latching mechanisms are fully or securely engaged. A secondary function often is to prevent the latching mechanisms from inadvertently unlatching and permitting the connectors to separate. These connector position assurance functions may be accomplished in a variety of ways, but many prior art connector position assurance systems employ a spacer that cannot be inserted into its intended position unless the latching arm is fully engaged, and the latching arm cannot be moved when the spacer is properly positioned. Problems often are encountered with such removable spacers because they may be lost or misplaced. Therefore, in some connector position assurance systems, the spacers may be preloaded on the connector housing so that they cannot be lost or misplaced. However, one of the problems with such systems is that, should the preloaded spacer by inadvertently moved to its final locking position before the connectors are mated, mating cannot take place.

In addition, terminal position assurance devices also are known in the art. Typically, the primary function of such devices is to verify that the terminals of the connector are fully inserted to their final positions for proper mating with the terminals of the mateable connector or connecting device. This terminal position assurance function may be accomplished in a variety of ways, but a typical terminal position assurance system employs a member that is inserted into the connector housing to a given position which can be accomplished only if all of the terminals are fully inserted into the housing. For instance, if one or more of the terminals are not fully inserted, the terminal position assurance device is blocked from moving to its given position, thereby detecting or indicating that one or more terminals are improperly inserted.

In order to provide a single electrical connector with all of the functions described above by connector position assurance devices and terminal position assurance devices, the connector becomes quit(s complex and unnecessarily enlarged to accommodate the various devices and their supports, guides and other related structure. The present invention is directed to solving at least some of these problems by providing a unique connector position assurance system wherein a terminal position assurance device provides a guide means for a connector position assurance device, thereby eliminating portions of the connector housing which otherwise would be necessary to perform these functions.

SUMMARY OF THE INVENTION

An object, therefore, of the invention is to provide a new and improved connector position assurance system for an electrical connector adapted for mating with another mateable connecting device.

In the exemplary embodiment of the invention, a connector housing means includes a relatively movable locking arm having a latch for mechanically interlocking with a cooperating latch of the mateable connecting device. The housing means further includes at least one terminal-receiving passage, with a terminal positionable in the passage. A terminal position assurance device (TPA) is mountable on the housing means in a given position assuring proper positioning of the terminal in the passage. A connector position assurance device (CPA) is mountable on the housing means and is movable relative thereto between a first position allowing movement of the locking arm and mating of the connector with the mateable connecting device, and a second position blocking movement of the locking arm with the connector fully mated. The TPA includes guide means for guiding the CPA between its first and second positions.

As disclosed herein, the locking arm is movable relative to the housing means between a first position when the connector is fully mated and a second position of incomplete mating of the connector and the mateable connecting device. The locking arm, in its second position of incomplete mating, blocks movement of the CPA from its first position to its second position, thereby indicating that the connector is not fully mated.

According to one aspect of the invention, the guide means on the TPA comprise a pair of spaced guide rails between which the CPA is movable. The connector housing means include a pair of guide rails aligned with the guide rails on the TPA for guiding the CPA between its first and second positions.

According to another aspect of the invention, the connector housing means include a pair of housing parts. The CPA is movably mounted on one of the housing parts, and the TPA is mounted on the other housing part. The guide rails on the housing means are located on the one housing part.

Still further, the TPA is mountable on the housing means in a first direction, and the CPA is movable relative to the housing means in a second direction generally transverse to the first direction. The TPA is mountable on the housing means in a path intersecting the path of movement of the CPA, such that the CPA cannot move to its second position unless the locking arm is in its first position, i.e. unless the connector is fully mated. The connector can not be fully mated unless the TPA is in its final or given position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
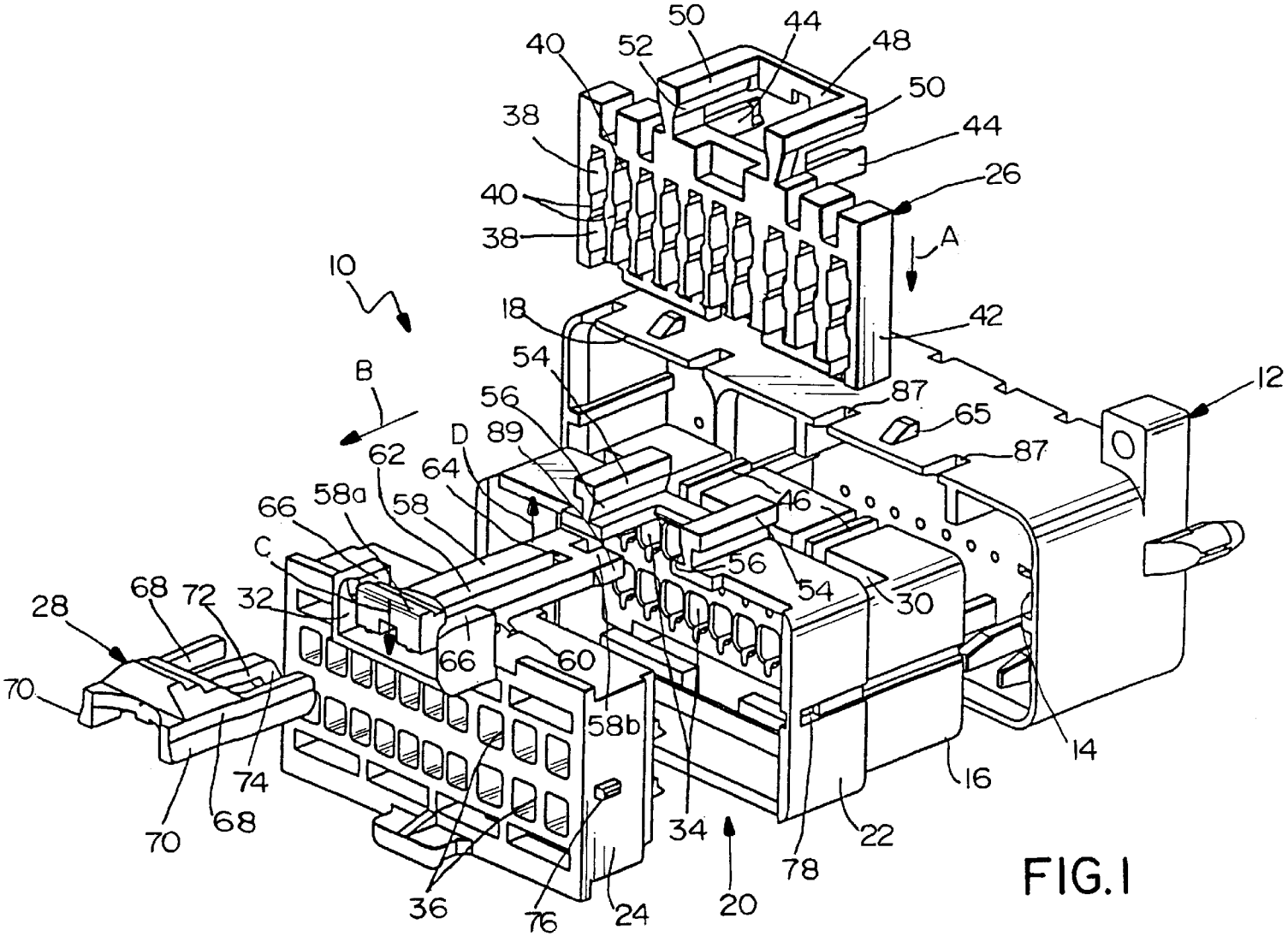
FIG. 1 is an exploded perspective view of an electrical connector assembly including an electrical connector embodying the concepts of the invention insertable into a mateable connecting device in the form of a header connector.

Referring to the drawings in greater detail, and first to FIG. 1, the invention is embodied in a connector position assurance system for an electrical connector, generally designated 10, which is adapted for mating with another mateable connecting device shown herein as a header connector, generally designated 12. Header connector 12 includes a large receptacle 14 for receiving a mating end 16 of connector 10, as well as a smaller receptacle 18 for receiving the mating end of a second connector described hereinafter in relation to FIGS. 3 and 4. The second connector, as well as the terminals of the connector assembly, are not shown in FIG. 1 in order to avoid cluttering the drawing which would detract from a clear depiction of the components of electrical connector 10.

More particularly, electrical connector 10, except for its terminals, is comprised of four components, namely: a housing means, generally designated 20, which includes a front housing part 22 and a rear housing part 24; a terminal position assurance device (TPA), generally designated 26; and a connector position assurance device (CPA), generally designated 28. TPA 26 is mountable on front housing part 22 by inserting the TPA into a slot 30 in the direction of arrow "A". Although shown in FIG. 1 exploded out on the left side of rear housing part 24, CPA 28 is mountable within a cage 32 of rear housing part 24 in the direction of arrow "B". Front housing part 22 has two rows of terminal-receiving passages 34, rear housing part 24 has two rows of-terminal-receiving passages 36 and TPA 26 has two rows of terminal-receiving passages 38, all of which are aligned when connector 20 is assembled. The TPA has narrowed portions 40 between passages 38 which will abut against portions of any terminal which is not fully inserted into the connector and, thereby, prevent the TPA from being fully inserted into front housing part 22 in the direction of arrow "A". Therefore, the incompletely inserted TPA will indicate that one or more terminals are not fully inserted into connector housing means 20. Furthermore, narrowed portions 40 will act as a secondary locking feature to retain the fully-inserted terminals in their correct positions, along with the primary locking arm discussed in more detail below.

Each of the four components of connector 10, namely: front housing part 22, rear housing part 24, TPA 26 and CPA 28 is a one-piece structure unitarily molded of dielectric material such as plastic or the like. TPA 26 basically is a generally rectangular block 42 having terminal-receiving passages 38 extending therethrough. A pair of mounting arms 44 project forwardly of block 42 and are insertable into appropriate mounting grooves 46 in the top of front housing part 22. A generally U-shaped CPA guide structure 48 also projects forwardly of block 42 at the top thereof. The guide structure includes a pair of generally parallel guide rails 50 which have interior guide channels formed by angled interior walls 52.

Front housing part 22 of connector 10 also has a pair of guide rails 54 defining interior guide channels formed by angled interior walls 56. When TPA 26 is fully inserted into slot 30 in the direction of arrow "A", guide rails 50 and interior guide channels 52 of the TPA are in alignment with guide rails 54 and interior guide channels 56 of the front housing part.

Rear housing part 24 of connector 10 includes a relatively movable locking arm 58 which is attached to the rear housing part by an integrally molded, flexible fulcrum 60. The latch arm has a central slot 62 which terminates in a rearwardly facing shoulder 64 which defines a latch for the locking arm which resiliently snaps behind a latch boss 65 on header connector 12. When a rear end 58*a* of locking arm 58 is depressed in the direction of arrow "C", the front latch end of the locking arm moves upwardly about fulcrum 60 in the direction of arrow "D".

CPA 28 of connector 10 is mountable within cage 32 of rear housing part 24 on top of locking arm 58 in the direction of arrow "B". Cage 32 has a pair of spaced, parallel guide rails 66 which are aligned with guide rails 54 of front housing part 22 and guide rails 50 of TPA 26 when the connector is assembled. CPA 28 has a pair of generally parallel guide rails 68 having outwardly flared or enlarged bottom edges defined by outwardly angled side walls 70. These enlarged, outwardly flared bottom edges of guide rails 68 are captured within interior guide channels 56 of guide rails 54 and interior guide channels 52 of guide rails 50 of front housing part 22 and TPA 26, respectively. In other words, CPA 28 cannot be lifted off of the connector assembly, because outwardly flared lower edges 70 of guide rails 68 are captured within the interior guide channels of the front housing part and the TPA, as well as within the short guide rails 66 of the rear housing part.

CPA 28 also has a forwardly projecting actuating arm 72 having a downwardly angled front latching tip 74. The front latching tip rides within slot 62 of locking arm 58 for purposes described hereinafter.

Figure 2:
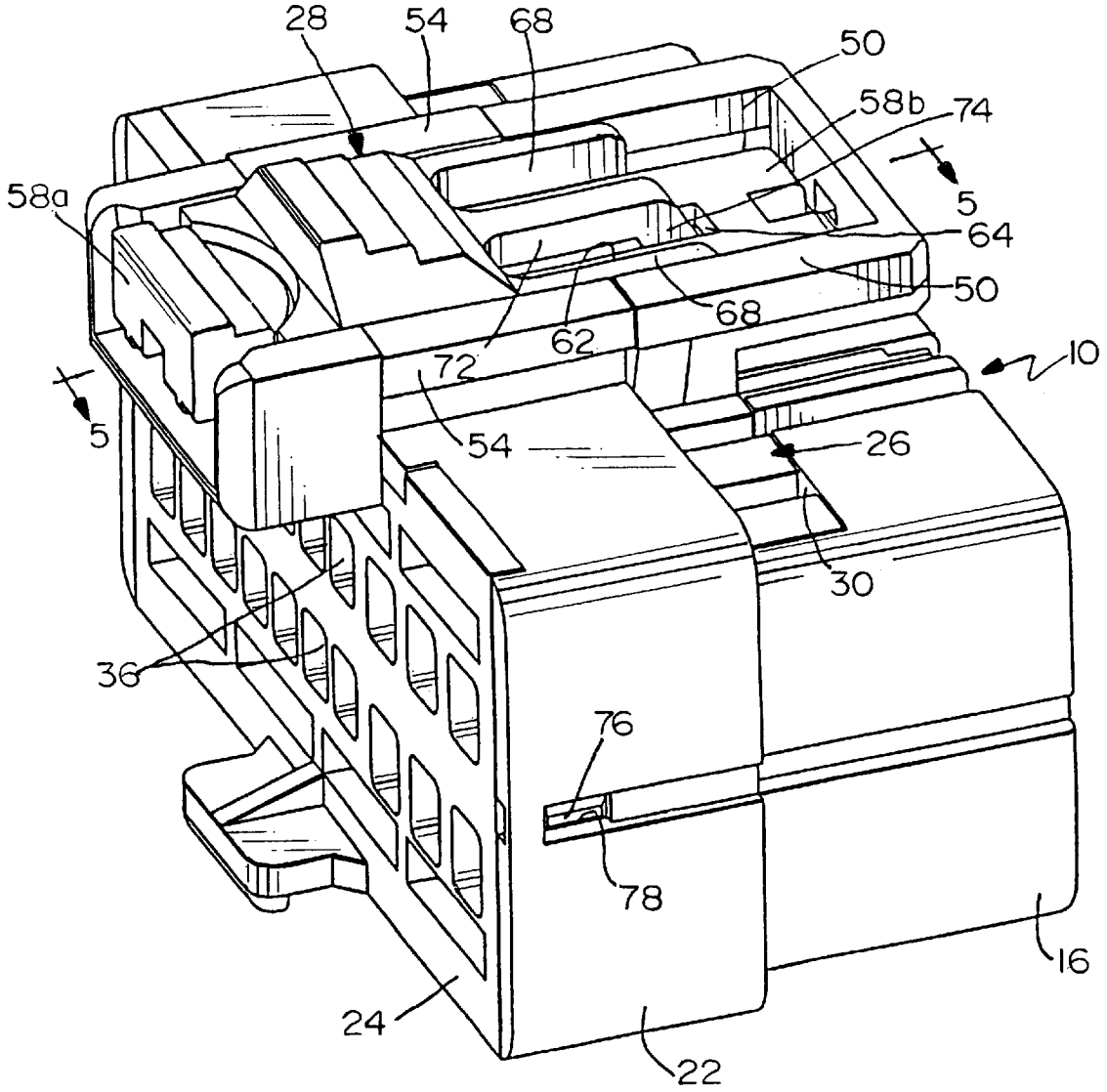
FIG. 2 is a perspective view of the connector in FIG. 1, in assembled condition.

FIG. 2 shows electrical connector 10 of FIG. 1 in fully assembled condition. It can be seen that TPA 26 has been fully inserted downwardly into slot 30 of front housing part 22, with the rear housing part 24 assembled to the front housing part. It can be seen that the rear housing part has a pair of side latch bosses 76 which snap into a pair of complementary side latch apertures 78 in the front housing part. CPA 28 is shown in assembled condition with guide rails 68 slidably movable between guide rails 54 of the rear housing part and guide rails 50 of the TPA. It also can be seen that front latching tip 74 of actuating arm 72 of the CPA is disposed within slot 62 of locking arm 58.

Figure 3:
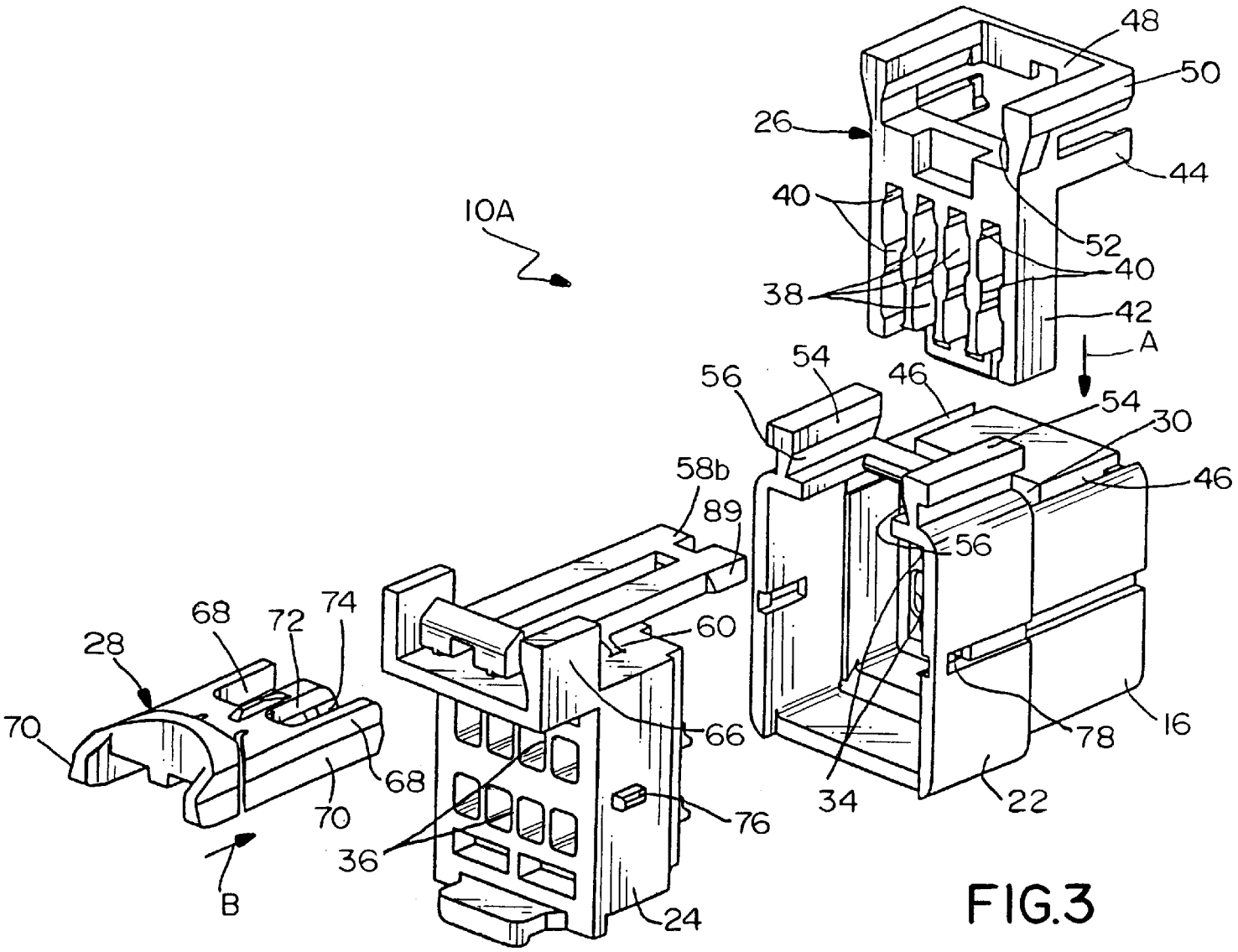
FIG. 3 is an exploded perspective view of a second electrical connector embodying the concepts of the invention and also insertable into the header connector of FIG. 1.
Figure 4:
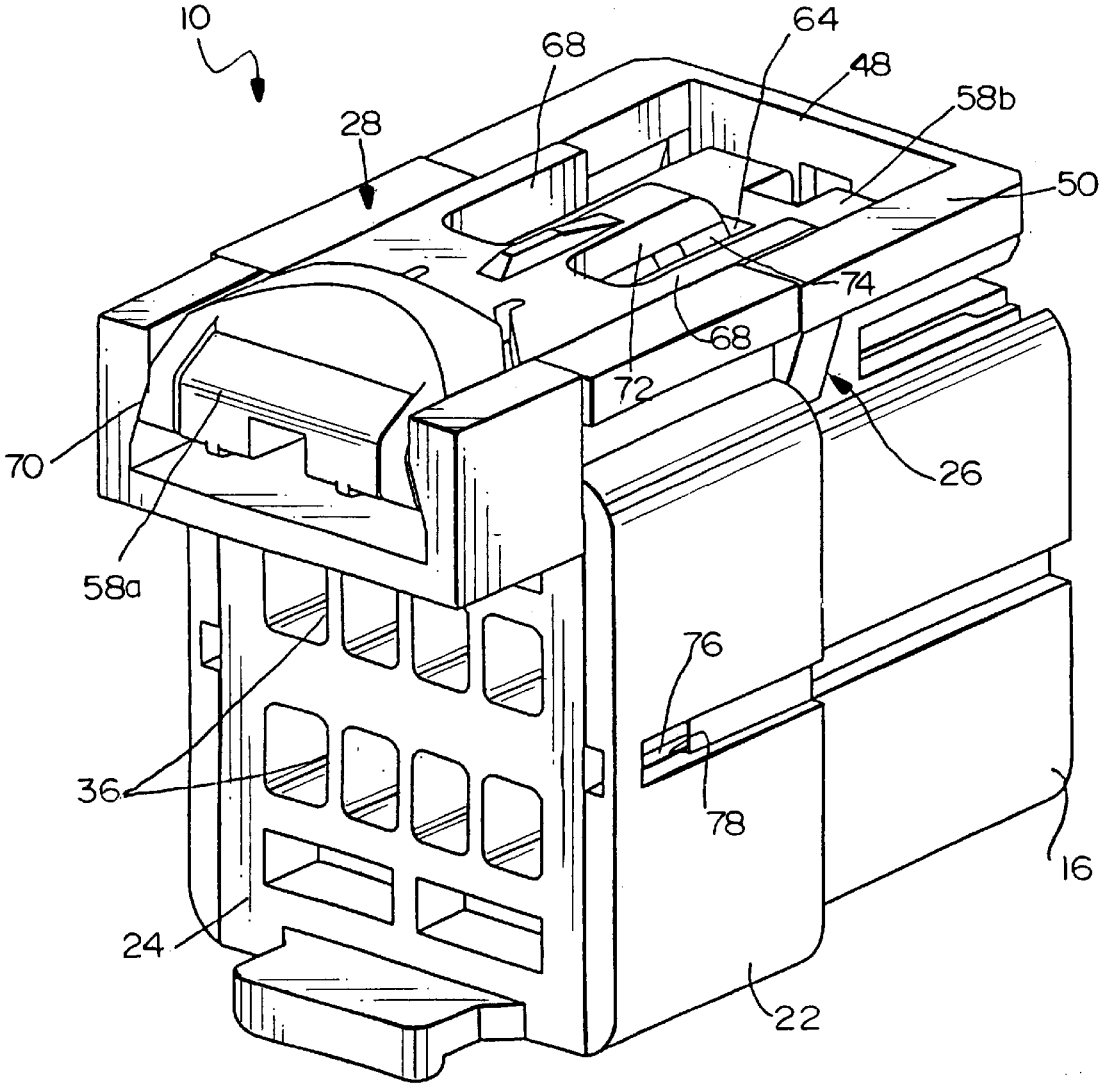
FIG. 4 is a perspective view of the connector of FIG. 3 in assembled condition.

FIGS. 3 and 4 show a second electrical connector, generally designated 10A, which is substantially identical to connector 10 (FIGS. 1 and 2), except that connector 10A is sized for insertion into the smaller receptacle 18 (FIG. 1) of header connector 12. Except for the size differential, connector 10A is substantially identical to connector 10 in structure, assembly and function. In other words, connector 10A includes a front housing part 22, a rear housing part 24, a TPA 26 and a CPA 28. Therefore, like reference numerals have been applied in FIGS. 3 and 4 corresponding to like components described above in relation to connector 10 in FIGS. 1 and 2.

Figure 5:
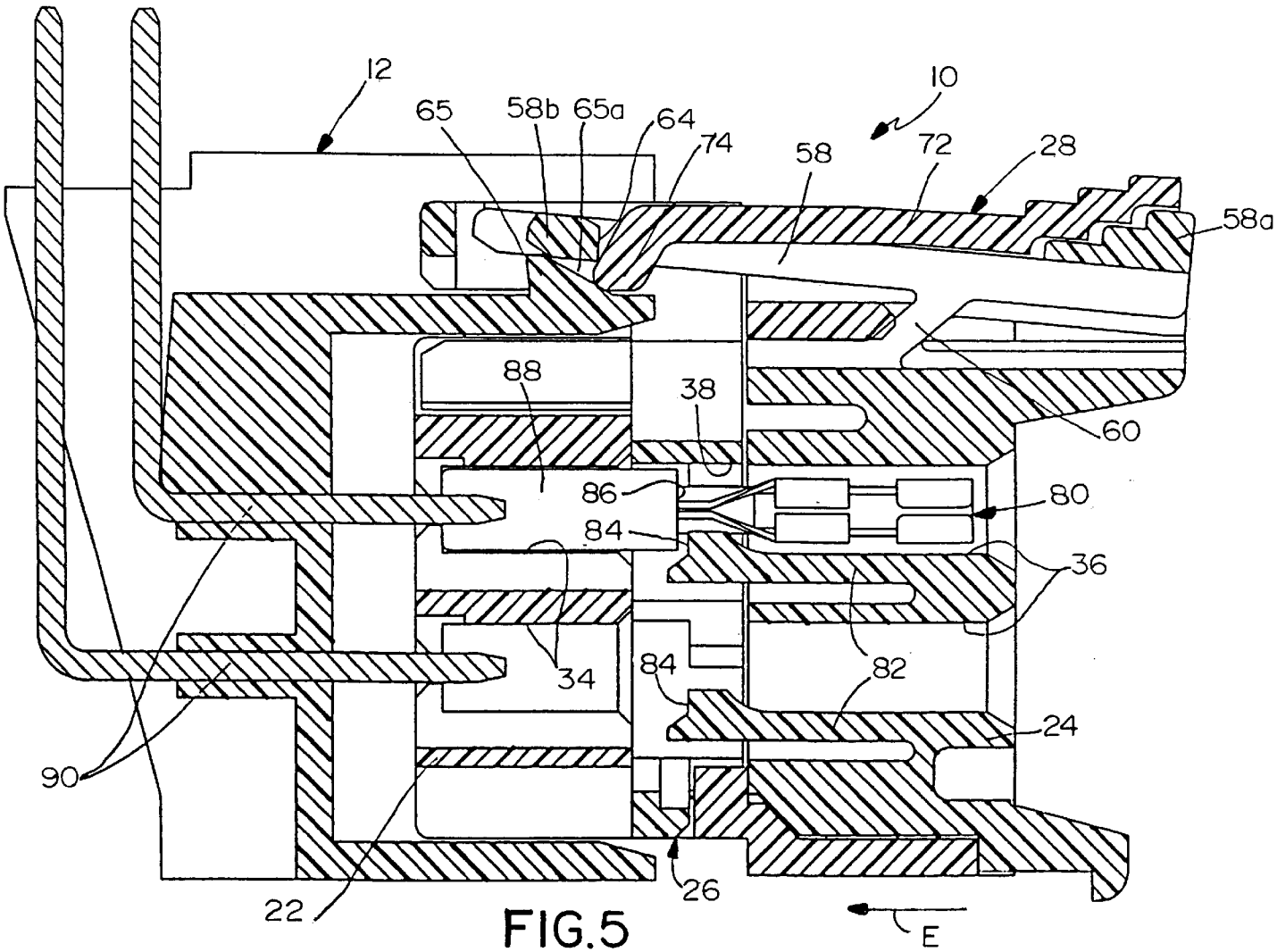
FIG. 5 is a vertical section taken generally along line 5—5 of FIG. 2, but also including the header connector, with the electrical connector only partially assembled to the header connector and the CPA in a preload position.
Figure 6:
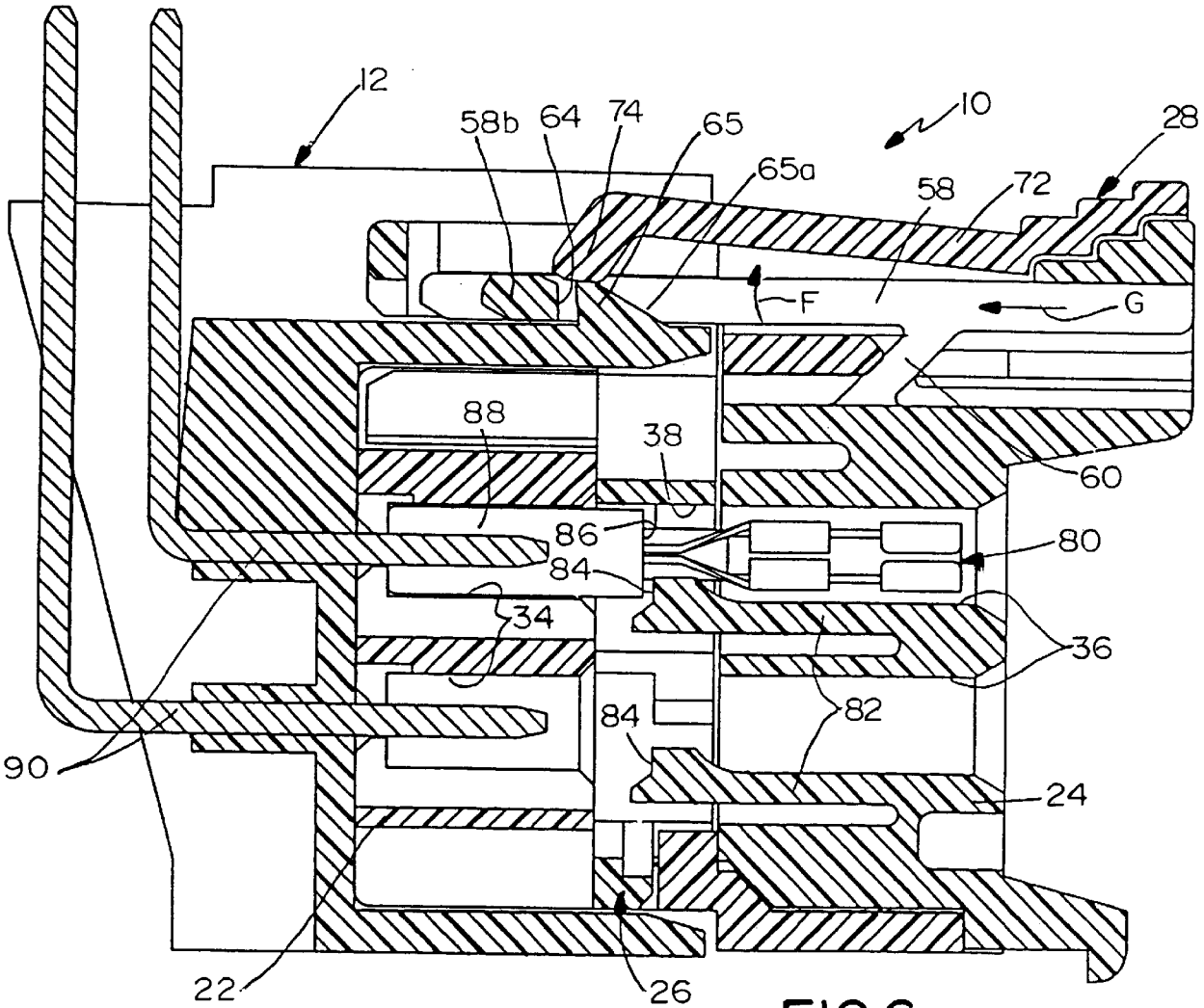
FIG. 6 is a view similar to that of FIG. 5, with the electrical connector fully mated and latched to the header connector, but with the CPA in an enabling position.
Figure 7:
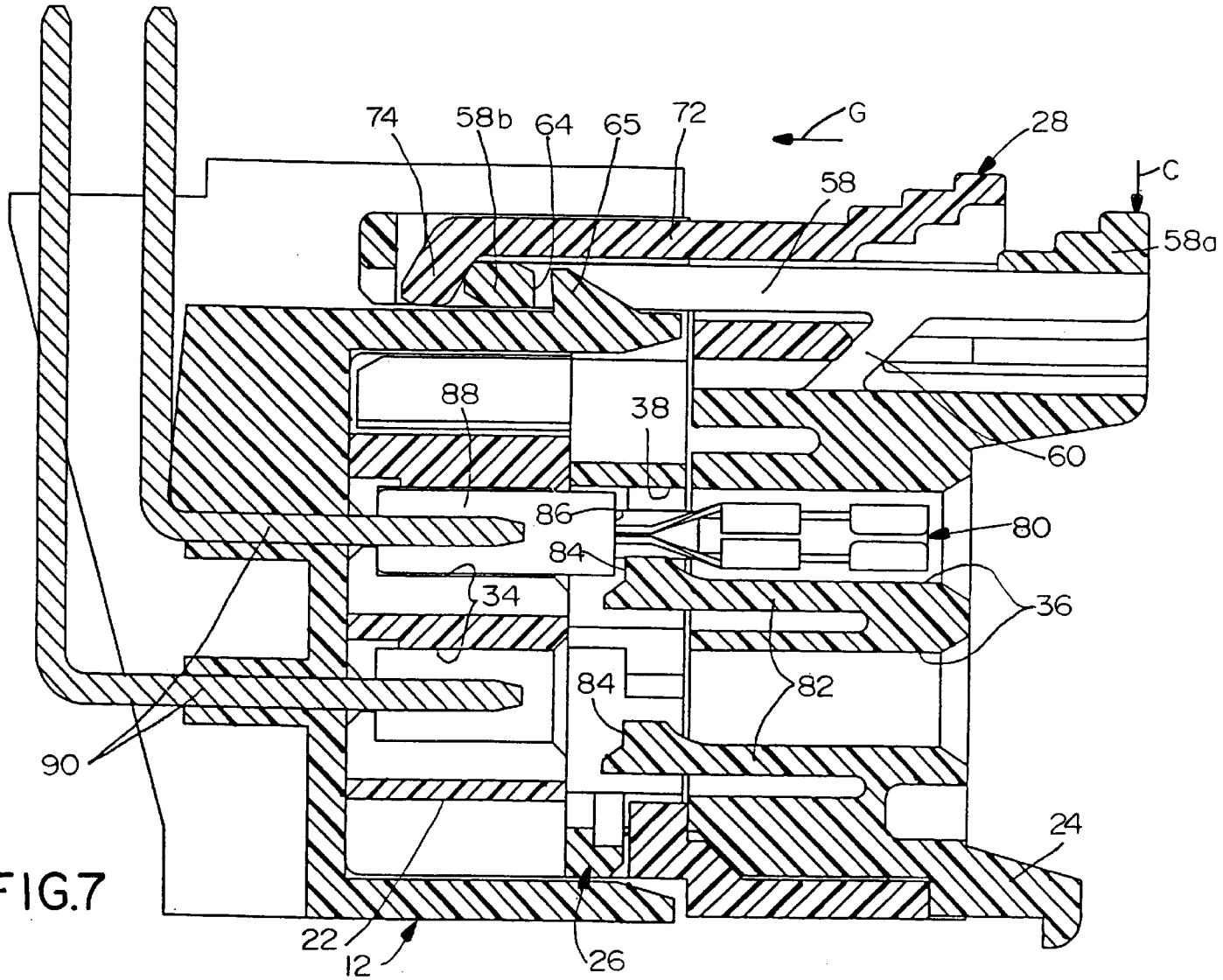
FIG. 7 is a view similar to that of FIG. 6, but with the CPA moved to its final position.

FIGS. 5–7 show sequential views of the assembly of connector 10 with header connector 12 as well as the functioning of locking arm 58 and CPA 28. Before proceeding with a description of the assembly and functioning of the components, it first should be noted that one of the terminals, generally designated 80, of the connector assembly has been inserted into one of the terminal-receiving passages 36 of rear housing part 24, one of the terminal-receiving passages 38 of TPA 26 and one of the terminal-receiving passages 34 of front housing part 22. Of course, it should be understood that one of the terminals 80 will be inserted into each of the terminal-receiving passages in the housing parts and the TPA. It also should be noted that rear housing part 24 has a primary locking arm 82 with a forwardly facing locking shoulder 84 within each of the composite terminal-receiving passages. Locking shoulder 84 of each primary locking arm is adapted for locking behind a shoulder 86 of the respective terminal inserted into the adjacent passage. Finally, it also should be noted that if any one terminal 80 is not fully inserted into its respective passage(s), an enlarged front portion 88 of the terminal will block movement of the enlarged portions 40 (FIG. 1) of the TPA and, thereby, prevent the TPA from moving to is final terminal position assurance position. A pair of terminal pins 90 are shown mounted within header connector 12 for mating engagement with terminals 80 of connector 10. If TPA 26 is not fully inserted to the position shown in FIGS. 5–7, it will block full assembly of the two housing parts due to mounting arms 44 of block 42 stubbing on or interfering with slot walls 87 in front housing part 22.

FIG. 5 shows connector 10 just slightly prior to insertion into header connector 12 in the direction of arrow "E". Prior to mating of the connectors, it can be seen that front latching tip 74 of actuating arm 72 of CPA 28 abuts against latch shoulder 64 of locking arm 58. This prevents the CPA from inadvertently moving to its final locking position before the connectors are mated. In other words, CPA 28 is maintained in a preload position shown in FIG. 5 prior to latching of connectors 10 and 12. FIG. 5 shows the front end 58*b* of locking arm 58, immediately forward of latching shoulder 64, riding up an angled surface 65*a* of latch 65 on header connector 12.

FIG. 6 shows connector 10 fully mated and latched with header connector 12. It can be seen that latch shoulder 64 at the front of locking arm 58 has resiliently snapped behind latch 65 of the header connector. During final latching movement between the connectors, front latching tip 74 of actuating arm 72 of the CPA rides up angled surface 65*a* of latch 65 as indicated by arrow "F". Latching tip 74, thereby, is moved out of locking engagement with latch shoulder 64 and now can be moved forwardly in the direction of arrow "G".

FIG. 7 shows CPA 28 having been moved forwardly in the direction of arrow "G" until front latching tip 74 of actuating arm 72 snaps over the front end 58*b* of locking arm 58. The outside surface of front end 58*b* of locking arm 58 has an angled or wedged surface 89 (FIGS. 1 and 3) which opposes a wedged surface (not shown) along an inside wall of rail 68 to prevent locking arm 58 from moving upward and to therefore retain the locking arm in its locked position particularly in the event that pressure is applied to the rear end 58*a* of the locking arm in the direction of arrow "C".

When it is desired to unmate connectors 10 and 12, CPA 28 is moved rearwardly opposite the direction of arrow "G" from the final position shown in FIG. 7 to the preload position shown in FIG. 6. The rear end 58*a* of locking arm 58 then can be depressed as shown in FIG. 5 to lift latch 64 of connector 10 off of latch 65 of header connector 12, and the connectors can be unmated.

Second connector 10A, being of substantially identical structure to connector 10, functions substantially identical to the description of connector 10 in relation to FIGS. 5–7. Therefore, the description will not be repeated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A connector position assurances system for an electrical connector adapted for mating with another mateable connecting device, comprising:

a connector housing means including a relatively movable locking arm having a latch for mechanically interlocking with a cooperating latch of the mateable connecting device, the housing means further including least one terminal-receiving passage;

at least one terminal positionable in said passage;

a terminal position assurance device (TPA) mountable on the housing means in a given position assuring proper positioning of the terminal in the passage;

a connector position assurance device (CPA) mountable on the housing means and movable relative thereto between a first position allowing movement of said locking arm and mating of the connector and the mateable connecting device and a second position blocking movement of the locking arm with the connector fully mated; and the TPA including guide means for guiding the CPA between its first and second positions.

2. The connector position assurance system of claim 1 wherein said locking arm is movable relative to the housing means between a first position when the connector is fully mated and a second position of incomplete mating of the connector and the mateable connecting device, and the locking arm in its second position of incomplete mating blocking movement of the CPA from its first position to its second position thereby indicating the connector is not fully mated.

3. The connector position assurance system of claim 1 wherein said guide means on the TPA comprise a pair of spaced guide rails between which the CPA is movable.

4. The connector position assurance system of claim 3 wherein said connector housing means include a pair of guide rails aligned with the guide rails on the TPA for guiding the CPA between its first and second positions.

5. The connector position assurance system of claim 4 wherein said connector housing means include first and second housing parts, the CPA being movably mounted on the first housing part, and said guide rails on the housing means being on the second housing part.

6. The connector position assurance system of claim 5 wherein said TPA is mountable on the second housing part.

7. The connector position assurance system of claim 1 wherein said connector housing means include a pair of housing parts, the CPA being movably mounted on one of the housing parts and the TPA being mounted on the other housing part.

8. The connector position assurance system of claim 1 wherein said connector housing means include guide means cooperating with the guide means on the TPA for guiding the CPA between its first and second positions.

9. The connector position assurance system of claim 1 wherein said TPA is mountable on the housing means in a first direction, and the CPA is movable relative to the housing means in a second direction generally transverse to said first direction.

10. The connector position assurance system of claim 1 wherein said TPA is mountable on the housing means in a path intersecting the path of movement of said CPA, such that the CPA cannot move to its second position unless the connector is fully mated and the TPA is in said given position.

11. A connector position assurance system for an electrical connector adapted for mating with another mateable connecting device, comprising:

a connector housing means having at least one terminal-receiving passage and including a locking arm adapted for latching with the mateable connecting device;

at least one terminal positionable in said passage;

a terminal position assurance device (TPA) mountable on the housing means;

a connector position assurance device (CPA) movably mounted on the housing means and operatively associated with said locking arm; and the TPA including guide means for guiding movement of the CPA.

12. The connector position assurance system of claim 11 wherein said locking arm is movable relative to the housing means between a first position when the connector is fully mated and a second position of incomplete mating of the connector and the mateable connecting device, and the locking arm in its second position of incomplete mating blocking movement of the CPA.

13. The connector position assurance system of claim 11 wherein said guide means on the TPA comprise a pair of spaced guide rails between which the CPA is movable.

14. The connector position assurance system of claim 13 wherein said connector housing means include a pair of guide rails aligned with the guide rails on the TPA for guiding the CPA between its first and second positions.

15. The connector position assurance system of claim 14 wherein said connector housing means include first and second housing parts, the CPA being movably mounted on the first housing part, and said guide rails on the housing means being on the second housing part.

16. The connector position assurance system of claim 15 wherein said TPA is mountable on the second housing part.

17. The connector position assurance system of claim 11 wherein said connector housing means include a pair of housing parts, the CPA being movably mounted on one of the housing parts and the TPA being mounted on the other housing part.

18. The connector position assurance system of claim 11 wherein said connector housing means include guide means cooperating with the guide means on the TPA for guiding movement of the CPA.

19. The connector position assurance system of claim 11 wherein said TPA is mountable on the housing means in a first direction, and the CPA is movable relative to the housing means in a second direction generally transverse to said first direction.

20. The connector position assurance system of claim 11 wherein said TPA is mountable on the housing means in a path intersecting the path of movement of said CPA, such that the CPA cannot move unless connector is fully mated and the TPA is in said given position.

* * * * *